United States Patent [19]

Herz et al.

[11] Patent Number: 4,749,646

[45] Date of Patent: Jun. 7, 1944

[54] SILVER HALIDE PHOTOSENSITIVE MATERIALS CONTAINING THIOUREA AND ANALOGUE DERIVATIVES

[75] Inventors: Arthur H. Herz, Rochester; George J. Burgmaier, Pittsford, both of N.Y.

[73] Assignee: Eastman Kodak Company, Rochester, N.Y.

[21] Appl. No.: 29,128

[22] Filed: Mar. 23, 1987

[51] Int. Cl.[4] ..... G03C 1/02

[52] U.S. Cl. ..... 430/569; 430/567; 430/566; 430/603; 430/671

[58] Field of Search ..... 430/567, 569, 603, 566, 430/611

[56] References Cited

U.S. PATENT DOCUMENTS

| | | | |
|---|---|---|---|
| 3,598,598 | 8/1971 | Herz | 430/607 |
| 4,221,863 | 9/1980 | Overman et al. | 430/567 |
| 4,266,018 | 5/1981 | Ishiguro et al. | 430/550 |
| 4,284,717 | 8/1981 | Toya et al. | 430/567 |
| 4,629,678 | 12/1986 | Murai | 430/230 |
| 4,678,745 | 7/1987 | Yamada et al. | 430/569 |

FOREIGN PATENT DOCUMENTS

| | | | |
|---|---|---|---|
| 82408 | 7/1978 | Japan | 430/567 |

OTHER PUBLICATIONS

"Particle Growth in Suspension", Academic Press, London, 1973, p. 159, Oppenheimer et al.

*Primary Examiner*—Roland E. Martin
*Assistant Examiner*—Patrick A. Doody
*Attorney, Agent, or Firm*—Thomas H. Kirchoff

[57] ABSTRACT

A photographic silver halide emulsion comprising a 1,1,3,3-tetrasubstituted middle chalcogen urea compound is described wherein at least one substituent comprises an acid function. The urea compound is an effective silver halide grain growth-modifying agent. A process for modifying the grain growth of silver halide is also described.

19 Claims, No Drawings

SILVER HALIDE PHOTOSENSITIVE MATERIALS CONTAINING THIOUREA AND ANALOGUE DERIVATIVES

This invention relates to a silver halide photographic emulsion and to a process for preparation thereof. In particular, this invention relates to use of a urea compound as a grain growth modifying agent for silver halide.

Numerous thiourea compounds have been described as having utility in the the photographic art. These uses include growth modification of silver halide grains. For example, the monograph "Particle Growth in Suspension", Academic Press, London, 1973, contains a paper by Oppenheimer, James and Herz (p. 159) which discloses that 1,1,3,3-tetramethyl-2-thiourea is a highly effective ripening agent for silver bromide.

U.S. Pat. No. 4,221,863 discloses the use of substituted thiourea compounds as agents for promoting the growth of silver halide grains during the precipitation and ripening steps. The identified thiourea compounds, typical of which is 1,1,3,3-tetramethyl-2-thiourea, are described as being capable of promoting uniform growth of silver halide grains with respect to both size and crystal habit. However, as is shown below by comparative tests, the tetramethyl substituted thiourea compound is not a useful silver halide growth modifying agent as compared with compounds of this invention. Moreover, this prior art compound is also shown as inducing fog formation and causing desensitization of silver halide grains.

Japanese Public Disclosure 82408/1978 relates to the use of tetrasubstituted thiourea compounds as solvents for silver halide precipitation. The specifically illustrated compounds fail to describe a single tetrasubstituted thiourea having the substituents which are necessary to achieve the desired growth modification of silver halide grains. This is illustrated below by comparative data.

U.S. Pat. No. 3,598,598 relates to the use of particular thionamide compounds as antifoggants and stabilizers for photographic silver halide elements. The tetrasubstituted compound 1,3-dimethyl-1,3-di-(p-carboxylphenyl)-2-thiourea is shown to reduce fog formation in gold and sulfur sensitized silver bromoiodide emulsions. However, as is shown below by comparative data this acid-substituted thiourea compound is not a useful silver halide grain growth-modifying agent.

Accordingly, there remains a need to obtain effective silver halide growth-modifying agents which do not cause objectionable fog in photographic silver halide.

The present invention provides a radiation sensitive silver halide emulsion which comprises a growth-modifying amount of a tetrasubstituted urea compound having the structural formula:

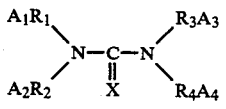

wherein

X is a middle chalcogen, i.e., a Group VIA atom below oxygen and above polonium;

each of $R_1$, $R_2$, $R_3$ and $R_4$, independently, can represent an alkylene, cycloalkylene, alkarylene, aralkylene or heterocyclic arylene group; or taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$, independently, is hydrogen or represents a radical comprising an acidic group;

with the proviso that at least one of $A_1R_1$ to $A_4R_4$ contains an acidic group bonded to a urea nitrogen atom through a chain comprising at least 4 atoms, preferably from 4 to 6 atoms.

The Group VIA atoms represented by X in the above formula include selenium and tellurium as well as sulfur. Sulfur is the preferred Group VIA atom due to ready availability of starting materials for thiourea synthesis and greater solubility of the thiourea compounds in aqueous solutions where silver halide grain growth modification occurs.

By the term "acidic group" is meant acids which have a dissociation constant, i.e., a pKa, smaller than about 7. Examples of such acidic groups include, but are not limited to, the OH portion of oxygen acids such as carboxylic (—COOH), sulfinic (—$SO_2H$), sulfonic (—$SO_3H$) and hydroxamic (—NHOH), and the NH portion of nitrogen acids such as for example sulfonamides (—$SO_2NH$—).

Inorganic and organic salts of these acids are equally useful.

A preferred acidic group is carboxylic, including carboxylate ions derived from salts thereof, wherein the —COOH is bonded through a propylene group to a thiourea nitrogen atom.

Other than the required acidic group which is attached to the urea nitrogen atom through a chain having at least 4 atoms, as defined, the composition of the remaining RA groups on the 1,1,3,3-tetrasubstituted urea compound can vary widely for achieving the desired modification of silver halide grain growth.

The presence of at least one acidic group, as defined, on the urea compound is necessary for useful growth modification of silver halide grains. This is demonstrated below by comparative data.

Alkylene groups which can be represented by at least one of $R_1$ to $R_4$ which are not bonded to the required acidic group can contain from 1 to about 6 carbon atoms, preferably from 1 to about 4 carbon atoms for greater solubility properties.

When one or more $R_1$ to $R_4$ group are cycloalkylene the ring portion can contain from about 3 to about 8, preferably about 5 or 6 carbon atoms. Where a cycloalkylene group has the required acidic group bonded thereto it is important for successful operation of this invention that such group be bonded to one of the urea nitrogen atoms through a chain having at least 4 atoms.

Where one of the $R_1$ to $R_4$ groups is a heterocyclic arylene ring, such ring can comprise from 5 to about 10 atoms in the ring, such as for example pyrrole, morpholine and quinolyl. When the heterocyclic arylene ring has bonded thereto the required acidic group, the chain separating the acidic group from a urea nitrogen atom comprises at least 4 atoms.

Where an $R_1$ to $R_4$ group is an alkarylene or an aralkylene, the alkylene moiety thereof can comprise from about 1 to about 3 carbon atoms and the aryl portion can be an aromatic group such as phenyl or naphthyl. When the required acid group is bonded to an aralkylene group, the chain separating the acidic group from the urea nitrogen atom must comprise at least 4 atoms.

Heterocyclic rings which can be formed by a urea nitrogen atom with $R_1$ and $R_2$ or with $R_3$ and $R_4$ can comprise 5 or 6 ring members. Typical heterocyclic rings so formed include pyridine, morpholine, piperdine and diazine.

Specific tetrasubstituted thiourea compounds useful in this invention include the following:

1. 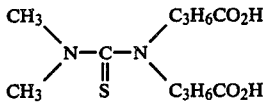

2. 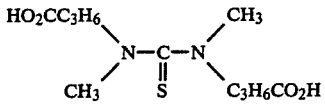

3. 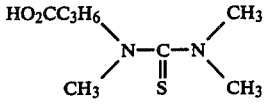

4. 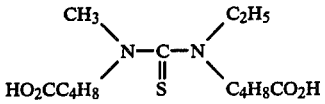

5. 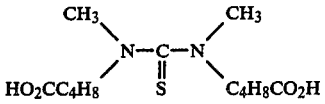

6. 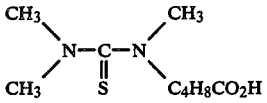

7. 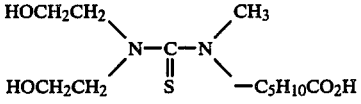

8. 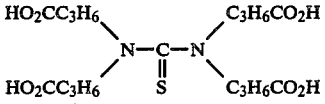

9. 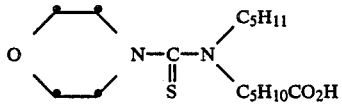

10. 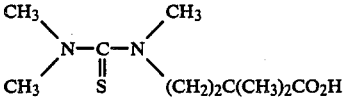

11. 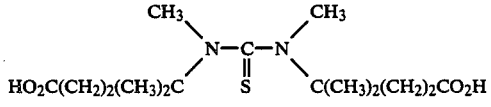

12. 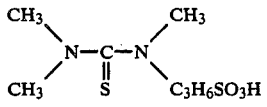

-continued

13. 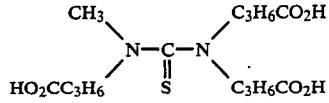

Synthesis of thiourea compounds of this invention can be effected by different techniques known in the art. One method, for example, comprises reacting an aliphatic monoaminocarboxylic acid with a dialkylthiocarbamoyl halide. This method is illustrated below with respect to preparation of Compound 3.

Synthesis of Compound 3[1-(3-carboxypropyl)-1,3,3-trimethyl-2-thiourea]

A. To a 1 liter flask was added 37.97 g (0.31 mol) dimethylthiocarbamoyl chloride, 51.51 g (0.31 mol) ethyl 4-methylaminobutyrate hydrochloride, 450 ml dry acetonitrile and 120 ml (0.66 mol) diisopropylethylamine. The solution was heated with stirring at 60°–70° C. for 6 hours, cooled to room temperature, and concentrated to dryness. To the residue was added 200 ml ether, 400 ml water and 30 ml 12N HCl. The layers were separated and the aqueous phase extracted twice more with ether. The combined ether solutions were washed with 100 ml of 1N HCl and then with water. After drying over anhydrous magnesium sulfate, the solvent was removed, followed by distillation of the product, bp 150°–158° C. at 0.25 mm Hg. The yield was 19.90 g (28%). The NMR, IR, and combustion analyses were consistent with the assigned structure for 1-(3-ethoxycarbonylpropyl)-1,3,3-trimethyl-2-thiourea.

B. To a solution of 50 ml water and 100 ml acetone was added 6 g (96 mmol) of sodium hydroxide and 5.56 g (24 mol) of the above described 1-(3-ethoxycarbonylpropyl)-1,3,3-trimethyl-2-triourea. The solution was stirred at room temperature for 1.0 hour. After cooling with ice/water, a solution of 8 ml 12N HCl in 15 ml water was added. The solvent was removed, and a solution of 1.5 g NaOH in 25 ml water added. The aqueous phase was extracted three times with diethylether, and then acidified with dilute HCl. After extracting the acidified solution six times with ether, the combined organic extracts were dried over magnesium sulfate and concentrated to an oil which was distilled, yielding 4.03 g of product, b.p. 175° C./0.15 mm Hg. The combustion analyses, NMR, and IR were consistent with assigned structure for Compound 3.

This invention also provides a process for the growth modification of silver halide grains which comprises adding from about $10^{-6}$ to about $10^{-1}$ mol of a urea compound, as described above, to said emulsion per mol of silver halide during preparation thereof or prior to coating the emulsion on a support. A preferred concentration of urea compound to achieve growth modification of silver halide is from about $10^{-4}$ to about $10^{-2}$ mol thereof per mol of silver halide.

In the present invention the described urea compounds may be added to the silver halide emulsion at various stages during preparation in the approximate ranges pH 2 to 8 and pAg 3 to 12. They may be added singly or in combination with other urea compounds, including other growth modifying agents or spectral sensitizers, stabilizers, antifoggants and other useful emulsion additives. For example, the compounds may be added during formation of silver halide grains or during the physical or chemical ripening stage. The silver halide grains can be formed according to processes generally well known in the art, with a double jet type process being preferred.

The double jet process comprises adding an aqueous silver nitrate solution and an aqueous solution of one or more halides, for example, an alkali metal halide such as potassium bromide, potassium chloride, potassium iodide or mixtures thereof, simultaneously or sequentially to a stirred solution of silver halide-protecting colloid (e.g., gelatin or gelatin derivative) through separate jets. A urea compound as described herein is preferably added to the protective colloid solution before initiation of silver halide formation.

The silver halide grains can be of any halide composition (e.g., silver bromide, silver bromoiodide, silver chloride, or silver chlorobromoiodide), of any size (e.g., coarse or fine), and can be of any regular or irregular shape (e.g., spherical, regular cubic, regular octahedral, cubo-octahedral, or tabular octahedral) known to be useful in photography, conventional vehicles can be used, such as those descrived in *Research Disclosure* (RD) Vol. 176, December 1978, Item 17643, Paragraph IX.

Incorporation of a urea compound as described herein in a silver halide emulsion layer can be achieved at various steps in the preparation of the emulsion. The preparation of silver halide emulsions is well known and is described, for example, in paragraphs I and II of the RD publication noted above. The emulsions can be chemically sensitized as described in paragraph III of the same RD publication noted above. The urea compound can also be incorporated in the chemical sensitization step, preferably simultaneously with other chemical sensitizing agents. Useful amounts of urea compound will vary depending upon such factors as the type of emulsion, the particular urea compound selected, and the specific effects that are sought. Generally, amounts within the ranges noted above are sufficient to accomplish the objects of this invention.

Preferably, chemical sensitizing agents employed in combination with urea compounds as dislosed herein are sulfur compounds and/or selenium and gold compounds. In comparison to urea compounds used in the prior art, the compounds described herein provide improved results without undesirable fog increase or loss of spectral sensitivity. This is shown by examples below.

Conditions for forming modified silver halide grains such as pH, pAg, temperature, etc., are not particularly limited when employed using compounds described herein. The pH is generally about 1 to 9, preferably about 2 to 6, and pAg is generally about 5 to about 12, preferably from about 7 to about 10. Silver halide grains may be modified at temperatures between about 30° to about 90° C., with about 35° C. to about 70° C. being preferred.

Gelatin is preferred as the binder or protective colloid for the photographic emulsion of the present invention. However, other hydrophilic colloids are also suitable. For example, proteins such as gelatin derivatives, graft polymers of gelatin with other polymers, albumin, casein, cellulose derivatives such as hydroxyethyl cellulose, carboxymethyl cellulose, cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole, polyvinyl pyrazole can be used.

Acid-processed gelatin can be used as well as lime-processed gelatin. Further, gelatin hydrolyzates, and enzyme-hydrolyzed products of gelatin are also usable.

Surface active agents may be incorporated in a photographic emulsion layer or in another hydrophilic colloid layer as a coating aid to prevent build-up of static charge, to improve lubrication properties, to improve emulsion dispersion, to prevent adhesion, and to improve such photographic characteristics as acceleration of development, increase in contrast, or sensitization.

A photographic emulsion of the present invention may contain antifogging agents or emulsion stabilizing agents, such as for example azaindenes, thionamides, azoles and the like.

The photographic emulsion of the present invention may be spectrally sensitized with dyes. Dyes which can be used include cyanine dyes, merocyanine dyes, composite cyanine dyes, composite merocyanine dyes, and hemioxanol dyes. Particularly useful dyes are those belonging to the merocyanine class. These dyes contain as a basic heterocyclic ring nucleus any nucleus ordinarily used in cyanine dyes.

The photographic emulsion of the present invention may contain color image-forming couplers, i.e., compounds capable of reacting with an oxidation product of an aromatic amine (usually a primary amine) to form a dye. Non-diffusing couplers containing a ballast group are desirable. Either 4-equivalent and 2-equivalent couplers are usable. In addition, colored couplers showing the effect of color correction, or couplers releasing a development inhibitor upon development (so-called DIR couplers) may be used.

A photographic emulsion of the present invention is coated on a support conventionally used for photographic light-sensitive materials such as a flexible support (e.g., plastic film, paper, etc.) or a rigid support (e.g., glass, etc.) according to a dip-coating method, roller coating method, curtain coating method or extrusion coating method.

Emulsions of the present invention can be applied to a multilayer multicolor photographic material comprising a support having provided thereon at least two layers having different spectral sensitivities. Multilayer multicolor photographic materials usually comprise a support having provided thereon at least one red-sensitive emulsion layer, at least one green-sensitive emulsion layer, and at least one blue-sensitive emulsion layer. The order of these layers can optionally be selected as occasion demands. Usually, a cyan-forming coupler is associated with the red-sensitive emulsion layer, a magenta-forming coupler is associated with the green-sensitive emulsion layer, and a yellow-forming coupler is associated with the blue-sensitive emulsion layer. In some cases, however, different layer arrangements may be employed.

The photographic emulsions obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-amino-N-ethyl-N-hydroxy-ethylaniline, 3-methyl-4-amino-N-ethyl-N-hydroxyethylaniline, 3-methyl-4-amino-N-ethyl-N-methanesulfonamidoethylaniline and 4-amino-3-methyl-N-ethyl-N-methoxyethylaniline. In addition, the developing agents described in L.F.A. Mason, Photographic Processing Chemistry (Focal Press, 1966), pp. 226–229, as well as those described in U.S. Pat. Nos. 2,193,015 and 2,592,364 may be used.

A photographic emulsion of the present invention can be applied to many different silver halide photographic light-sensitive materials due to its high photographic sensitivity, contrast, and fog reduction. For example, it can be used in high speed black-and-white negative films, in X-ray films and in multilayer color negative films.

The following examples further illustrate the invention. All parts, percents and ratios are by weight unless otherwise specified.

EXAMPLE 1

Six emulsions were prepared as follows:

Silver bromide (8 mmoles) was dispersed at pH 3.0, pBr 3.0 in 0.02% by wt. gelatin (isoelectric point 4.9) containing 28 mmoles $KNO_3$ and 0.6 mmol of a compound indicated in Table I below. The emulsions were stirred for 17 hours at 25° C. Evaluation of resulting electron micrographs yielded the following average grain size data recorded in micrometers (μm).

EXAMPLE 2

Four emulsions were prepared as follows:

Polydispersed sulfur and gold sensitized AgBrI (94:6) emulsions containing a disulfoalkyl-substituted oxacarbocyanine spectral sensitizing dye (0.15 mmol/mol Ag) was coated at 4.89 $gAg/m^2$ and 11.08 g $gel/m^2$ on a poly(ethyleneterephthalate) film support. The dried coating was exposed for 1/25 sec (500 W, 3000° K.) through a graduated density step wedge and processed (4 min, 20° C.) in a hydroquinone/monomethyl-p-aminophenol sulfate developer such as those available under the tradenames Kodak Developer DK-50 and D-19. Unprocessed coatings were used for determination of absorptance (A) which is defined as $A=1-(R+T)$ where the last terms refer, respectively, to reflectance and transmittance. To test for storage stability unprocessed coatings were kept for one week (48.9° C. 50% RH) before processing. Wratten filters 16 and 61 were used for green exposures. Wratten filters 36 and 38A were used for blue exposures. Similar coatings were prepared containing thiourea compounds as identified, and in the amount shown, in Table II.

TABLE II

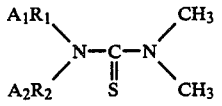

| Thiourea Compound | | | | | | % Absorbance | Relative Green | Fog | |
|---|---|---|---|---|---|---|---|---|---|
| Identity | mmol//Agmol | $A_1$ | $R_1$ | $A_2$ | $R_2$ | @ 550 nm | Sensitivity | Initial | Storage |
| None (control) | — | — | — | — | — | 63.9 | 100 | 0.15 | 0.88 |
| 3 (invention) | 0.3 | $-CO_2H$ | $-C_3H_6$ | $-H$ | $-CH_2$ | 63.1 | 94 | 0.14 | 0.56 |
| A (prior art) | 0.3 | $-H$ | $-CH_2$ | $-H$ | $-CH_2$ | 56.0 | 62 | 0.14 | 1.28 |
| E (comparison) | 0.1 | $-CO_2H$ | $-CH_2$ | $-H$ | $-CH_2$ | 62.7 | 19 | 0.58 | 1.35 |

Table II data shows that the prior art tetramethyl thiourea (Compound A) desensitizes the green-absorbing dye and causes severe fog on storage prior to use. As compared with Compound 3 of this invention, the closely related homolog Compound E, even at one-third the concentration of Compound 3, diminishes dye absorbance, severely desensitizes and causes high fog formation both prior to and after storage. These results make it apparent that in contrast to its analogs, the silver halide ripener of this invention induces little, if any, instability in the behavior of sensitized silver halide emulsion layers.

EXAMPLE 3

Six emulsions were prepared in the same manner as described in Example 2 except that the thiourea compounds, which are noted below in Table III, were each tested at a concentration of 1.0 mmol per mol Ag.

TABLE I

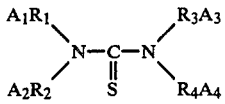

| Thiourea Compound | $A_1$ | $R_1$ | $A_2$ | $R_2$ | $A_3$ | $R_3$ | $A_4$ | $R_4$ | ECD,* μm |
|---|---|---|---|---|---|---|---|---|---|
| None (control | — | — | — | — | — | — | — | — | 0.166 |
| 2 (invention) | $-CO_2H$ | $-C_3H_6$ | $-H$ | $-CH_2$ | $-H$ | $-CH_2$ | $-CO_2H$ | $-C_3H_6$ | 0.297 |
| A (Prior Art) | $-H$ | $-CH_2$ | $-H$ | $-CH_2$ | $-H$ | $-CH_2$ | $-H$ | $-CH_2$ | 0.203 |
| B (Comparison) | $-CO_2H$ | $-CH_2$ | $-H$ | $-CH_2$ | $-H$ | $-CH_2$ | $-CO_2H$ | $-CH_2$ | 0.164 |
| C (Comparison) | $-CO_2H$ | $-C_2H_4$ | $-H$ | $-CH_2$ | $-H$ | $-CH_2$ | $-CO_2H$ | $-C_2H_4$ | 0.168 |
| D (Prior Art) | $-H$ | $-CH_2$ | (p)-$CO_2H$ | $-C_6H_4$ | $-H$ | $-CH_2$(p) | $CO_2H$ | $-C_6H_4$ | 0.157 |

*Equivalent Circular Diameter

From Table I it is apparent that the silver grain growth accelerating properties of Compound 2 of this invention are distinctly superior to those of Compounds A and D of the prior art. Structurally similar related homologs, Compounds B and C, are considerably inferior as evidenced by the results reflected in Table 1 and demonstrate their sensitivity to the acid group's chain length.

Compd. A is described in U.S. Pat. No. 4,221,863

Compd. D is described in U.S. Pat. No. 3,598,598

TABLE III

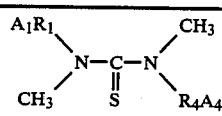

| Thiourea Compound | $A_1$ | $R_1$ | $A_4$ | $R_4$ | % Absorbance @ 550 nm | Relative Sensitivity Green | Relative Sensitivity Blue | Fog Initial | Fog Storage |
|---|---|---|---|---|---|---|---|---|---|
| None (control) | — | — | — | — | 58.8 | 100 | 100 | 0.17 | 0.70 |
| 2 (Invention) | $-CO_2H$ | $-C_3H_6$ | $-CO_2H$ | $-C_3H_6$ | 57.4 | 91 | 91 | 0.13 | 0.24 |
| A (prior art) | $-H$ | $-CH_2$ | $-H$ | $-CH_2$ | 31.9 | 20.5 | 41 | 0 16 | 1.72 |
| C (Comparison) | $-CO_2H$ | $-C_2H_4$ | $-C_2H$ | $-C_2H_4$ | 57.9 | 36 | 40 | 0.29 | 1.37 |

The data in Table III show that the tetramethylthiourea of the prior art (Compound A) adversely interferes with spectral response of the cyanine sensitizing dye and causes severe fog formation. Moreover, fog induction by the homologous carboxyethyl substituted thiourea (Compound C) reflects a distinctly opposite behavior as compared with Compound 2 of this invention.

These demonstrated comparative properties derived from the compoiund described herein are particularly important and establish that the urea compound does not induce storage fog and does not interfere with spectral sensitization of silver halide since residual amounts thereof are frequently retained in an emulsion layer following the precipitation and washing steps.

This invention has been described in detail with particular reference to preferred embodiments thereof, but it will be understood that variations and modifications can be effected within the spirit and scope of the invention.

What is claimed is:

1. A photographic silver halide emulsion comprising a 1,1,3,3-tetra-substituted urea compound having the structural formula:

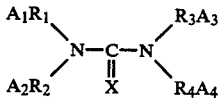

wherein

X is a middle chalcogen atom;

each of $R_1$, $R_2$, $R_3$ and $R_4$, independently, can represent an alkylene, cycloalkylene, alkarylene, aralkylene or heterocyclic arylene group, or taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$, independently, is hydrogen or represents a radical comprising an acidic group;

with the proviso that at least one of $A_1R_1$ to $A_4R_4$ contains an acidic group bonded to a urea nitrogen atom through a chain comprising at least 4 atoms wherein the acidic group has a dissociation constant pKa smaller than about 7 said urea compound being present in an amount of from about $10^{-6}$ to about $10^{-1}$ mol thereof per mol of silver halide.

2. The photographic emulsion of claim 1 wherein X is sulfur.

3. The photographic emulsion of claim 1 wherein the acidic group comprises the OH portion of an oxygen acid which is carboxylic, sulfinic, sulfonic or hydroxamic group.

4. The photographic emulsion of claim 3 wherein said acidic group is carboxylic acid or an inorganic or organic salt thereof.

5. The photographic emulsion of claim 1 wherein the compound is present in an amount of from about $10^{-4}$ to about $10^{-2}$ mol thereof per mol of silver halide.

6. The photographic emulsion of claim 1 wherein the compound is:

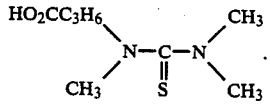

7. The photographic emulsion of claim 1 wherein the compound is:

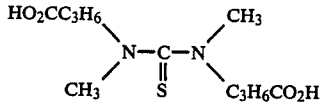

8. The photographic emulsion of claim 1 wherein the compound is:

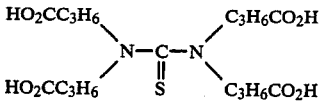

9. The photographic emulsion of claim 1 wherin the compound is:

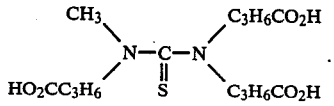

10. In a process for the growth modification of silver halide grains, the improvement which comprises adding, during preparation of said grains or prior to coating thereof on a support, from about $10^{-6}$ to about $10^{-1}$ mol per mol of silver halide of a compound having the structural formula:

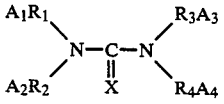

wherein

X is a middle chalcogen atom;

each of $R_1$, $R_2$, $R_3$ and $R_4$, independently, can represent an alkylene, cycloalkylene, alkarylene, aralkylene group or heterocyclic arylene group, or taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$, independently, is hydrogen or represents a radical comprising an acidic group;

with the proviso that at least one of $A_1R_1$ to $A_4R_4$ contains an acidic group bonded to a urea nitrogen atom through a chain comprising at least 4 atoms wherein the acidic group has a dissociation constant pKa smaller than about 7.

11. The process of claim 10 wherein X is sulfur.

12. The process of claim 10 wherein the acidic group comprises the OH portion of an oxygen acid which is a carboxylic, sulfinic, sulfonic or hydroxamic group.

13. The process of claim 12 wherein said acidic group is carboxylic or an inorganic or organic salt thereof.

14. The process of claim 10 wherein said compound is present in an amount of from about $10^{-4}$ to about $10^{-2}$ mol thereof per mol of silver halide.

15. The process of claim 10 wherein said compound has the structural formula:

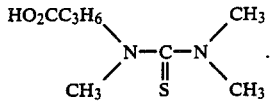

16. The process of claim 10 wherein said compound has the structural formula:

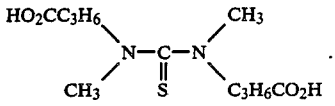

17. The process of claim 10 wherein said compound has the structural formula:

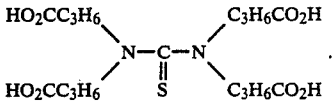

18. The process of claim 10 wherein said compound has the structural formula:

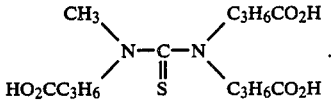

19. A silver halide emulsion prepared by the process of claim 10, 11, 12, 13, 14, 15, 16, 17 or 18.

* * * * *

UNITED STATES PATENT OFFICE

CERTIFICATE OF CORRECTION

PATENT NO. : 4,749,646

DATED : June 7, 1988

INVENTOR(S) : A.H. Herz and G.J. Burgmaier

It is certified that error appears in the above-identified patent and that said Letters Patent are hereby corrected as shown below:

Title page of the patent, item 45, date of patent "June 7, 1944" should read ---June 7, 1988---.

Column 10, line 48, "wherin" should read ---wherein---.

Signed and Sealed this

Fifteenth Day of November, 1988

*Attest:*

DONALD J. QUIGG

*Attesting Officer*

*Commissioner of Patents and Trademarks*